US005107650A

United States Patent [19]

Patrick

[11] Patent Number: 5,107,650

[45] Date of Patent: Apr. 28, 1992

[54] ANCHORAGES IN COMPOSITE STEEL AND CONCRETE STRUCTURAL MEMBERS

[75] Inventor: Mark Patrick, Greensborough, Australia

[73] Assignee: John Lysaght (Australia) Limited, Sydney, Australia

[21] Appl. No.: 458,641

[22] PCT Filed: Jun. 6, 1988

[86] PCT No.: PCT/AU88/00175

§ 371 Date: Jan. 30, 1990

§ 102(e) Date: Jan. 30, 1990

[87] PCT Pub. No.: WO88/09850

PCT Pub. Date: Dec. 15, 1988

[51] Int. Cl.[5] ..... E04B 1/16; E04C 5/03

[52] U.S. Cl. ..... 52/336; 52/334; 52/450; 52/674

[58] Field of Search ..... 52/334, 335, 336, 231, 52/414, 449, 450, 451, 630, 673, 674

[56] References Cited

U.S. PATENT DOCUMENTS

| | | | |
|---|---|---|---|
| 1,986,999 | 1/1935 | Burgess | 52/336 |
| 2,900,056 | 8/1959 | Greulich | 52/336 |
| 3,093,933 | 6/1963 | Slingluff . | |
| 3,094,813 | 6/1963 | Saxe | 52/336 |
| 3,372,523 | 3/1968 | Hall, Jr. | 52/336 |
| 3,385,015 | 5/1968 | Hadley | 52/334 |
| 3,564,799 | 2/1971 | Hanson | 52/334 |
| 3,600,868 | 8/1971 | Wilson, Jr. | 52/336 |
| 3,812,636 | 5/1974 | Albrecht et al. | 52/334 |
| 3,959,943 | 6/1976 | Shea et al. . | |
| 4,067,168 | 1/1978 | Thurner | 52/334 |
| 4,556,240 | 1/1986 | Schilger | 52/334 |
| 4,597,233 | 7/1986 | Rongoe, Jr. | 52/336 |

FOREIGN PATENT DOCUMENTS

| | | | |
|---|---|---|---|
| 1954684 | 5/1971 | Fed. Rep. of Germany . | |
| 2632961 | 7/1977 | Fed. Rep. of Germany | 52/336 |
| 190374 | 8/1986 | Fed. Rep. of Germany . | |
| 1476208 | 2/1967 | France . | |
| 2086613 | 12/1971 | France . | |
| 2384909 | 10/1978 | France . | |
| 0169358 | 12/1971 | New Zealand . | |
| 0170106 | 3/1974 | New Zealand . | |

*Primary Examiner*—Michael Safavi
*Attorney, Agent, or Firm*—Nikaido, Marmelstein, Murray and Oram

[57] ABSTRACT

This invention relates to the provision of mechanical anchorage in composite steel and concrete structural members such as slabs and beams, and more particularly to anchors adaptable as end anchors, to decking panels fitted with end anchors, and to composite structural members incorporating concrete slabs on such decking panels. According to a first aspect, the invention provides an anchor for composite steel and concrete structural members including an element of substantially rigid sheet material defining a base portion and at least two flange portions upstanding from the base portion, which element is a length to fit across a pan of a ribbed metal sheet with the flange portion extending across said pan, and means on or co-operable with the base portion engageable with complementary holes in the metal sheet so to extend through said holes, said means being adapted for holding the element in the metal sheet. The element preferably incorporates an integral channel which defines said base portion and a pair of said upstanding flange portions disposed at opposite edges of the base portion. The aforesaid means preferably includes plural stud elements of annular cross-section disposed for extending through said holes in the metal sheet. Such stud elements may be dimensioned to project integrally from a common backing plate through said holes in the metal sheet and registering apertures in said base portion.

36 Claims, 4 Drawing Sheets

ANCHORAGES IN COMPOSITE STEEL AND CONCRETE STRUCTURAL MEMBERS

This invention relates to the provision of mechanical anchorage in composite steel and concrete structural members such as slabs and beams, and more particularly to anchors adaptable as end anchors, to decking panels fitted with end anchors, and to composite structural members incorporating concrete slabs on such decking panels.

Composite steel and concrete structural members are normally formed in situ and typically comprise a concrete slab cast on underlying profiled steel sheet, commonly known as decking. The decking is usually an array of side-lapped panels, each with one to three longitudinally extending upstanding primary ribs and intermediate shallow stiffening ribs. The primary ribs may, for example, be of dovetail cross-section. It is known practice to anchor the slab and underlying sheet together against excessive relative longitudinal movement by providing transversely projecting keying elements, usually at regular intervals over the whole length of the sheet: these may be reinforcing rods welded to the rib tops (as, e.g., in Australian patent 223584 and French patent 1454164), tabs or perforations pressed from the ribs or pans of the sheet, or multiple shallow-ribbed embossments stamped to project out of the ribs or pans. It is also known to provide such anchorages only adjacent the ends of the sheet: one approach is to rely on the fastening of welded-stud or power-fastened shear connectors conventionally attached through the sheet onto the underlying supporting steel beams used in steel-frame composite building construction. An example of welded stud connection is provided by U.S. Pat. No. 3604167 to Hays. Such connectors cannot be welded to the sheet alone as the sheet is of insufficient gauge to provide a secure attachment. Another approach is to flatten the ends of the dovetail ribs using a hammer, and resistance from protrusion of the deformed rib into the concrete occurs to resist pull-out.

With the introduction of composite slabs and beams into construction of concrete-frame building structures, there is a requirement for these elements to be capable of carrying heavier loads and, as floor or roof components, spanning distances substantially further than those hitherto required in steel-frame construction. However, it is found that the beams or slabs may have inadequate load-baring capacity; loading of the span between supports puts the lower portion of the composite member into tension and induces concrete cracking and a shear force between the components of the composite member as the sheet is inclined to move inwardly from the supports and the concrete outwardly. Slippage between the steel and the concrete must be resisted if the slab or beam is to act compositely. Attempts to resolve this limitation by providing end anchorages of the known types have not been entirely successful: for example, the flattened rib ends lack sufficient mechanical strength and rigidity and tend to permit slip of the sheet ends. Welded-stud and power-fastened shear connectors, if sufficient in number, are prima facie satisfactory but their correct location relative to the edge of the plate is critically dependent on unskilled operators on site.

Another anchorage arrangement is disclosed in German patent application 2604399 by Muess. Multiple sets of three transverse curved anchoring rods extend through every second primary rib of the steel sheet but the maximum load capacity attainable with this arrangement is less than desirable and cannot be improved without enlarging the rod diameters to an impractical size. The desirable load capacity is greater than 100 kN per anchorage site. A similar approach, using transverse rods, is disclosed in German patent application 2521143 by Eggert.

U.S. Pat. No. 3,712,010 to Porter et al proposes upstanding brackets in the pans of a metal panel, for supporting longitudinal prestressing tendons. The brackets are simply welded to the panel and could not therefore have an adequate load capacity for the purpose now contemplated.

French patent 2359251 depicts U-shaped assembly ties for anchoring a profiled steel sheet to an underlying concrete beam or to an overlying concrete slab. The ties embrace the ribs and project through the sheet pans. The load capacity of such ties is clearly very limited for the proposed purpose and there is no positive securement between the slab and the sheet.

It is accordingly an object of the invention to provide an anchor adaptable to provide an improved end anchorage in composite steel and concrete structural members of adequate load capacity. It is also important that any end anchorage adopted is not susceptible to fatigue failure too early in the life of the structural member: such failure would in the medium term outweigh any advantages in countering longitudinal slip failure of the composite.

According to a first aspect, the invention provides an anchor for composite steel and concrete structural members comprising an element of substantially rigid sheet material defining a base portion and at least one flange portion upstanding from the base portion, which element is a length to fit across a pan of a ribbed metal sheet with the flange portion extending across said pan, and means on or co-operable with the base portion engageable with complementary holes in the metal sheet so to extend through said holes, said means being adapted for holding the element in the metal sheet.

The element preferably comprises an integral channel which defines said base portion and a pair of said upstanding flange portions disposed at opposite edges of the base portion. The aforesaid means preferably includes plural stud elements of annular cross-section disposed for extending through said holes in the metal sheet. Such stud elements may be dimensioned to project integrally from a common backing plate through said holes in the metal sheet and registering apertures in said base portion.

In a second aspect of the invention, there is provided a decking panel for a composite metal and concrete structural member comprising a ribbed metal sheet, and, to anchor the sheet and an overlying concrete slab against relative mechanical slippage in a direction parallel to ribs in the sheet, a plurality of end anchors secured to the sheet and disposed adjacent the ends of the sheet relative to said direction, each of which end anchors includes a portion projecting from the sheet and further includes means engageable with complementary holes in the metal sheet so as to extend through said holes, said means being adapted for holding the end anchor in the metal sheet.

The end anchors preferably comprise anchors according to the first aspect of the invention. Preferably, the outer rims of the aforementioned outer rims of said stud elements are deformed outwardly to lock them into place, clamping said base portion and said backing plate onto the metal sheet so as to thereby sandwich the metal sheet between the base portion and the backing plate.

Alternatively, the end anchors may be secured to the ribs: suitable anchors for this purpose may comprise a generally U-shaped or ring device, which embraces the respective rib and which may be resiliently expandible for fitting over the rib. With these forms of anchor, there are preferably at least three of the anchors adjacent the end of each primary rib.

The invention also provides a composite metal and concrete structural member comprising a slab of concrete cast on a decking panel according to the second aspect of the invention.

The invention will now be further described, by way of example only, with reference to the accompanying drawings, in which.

Figure 1:
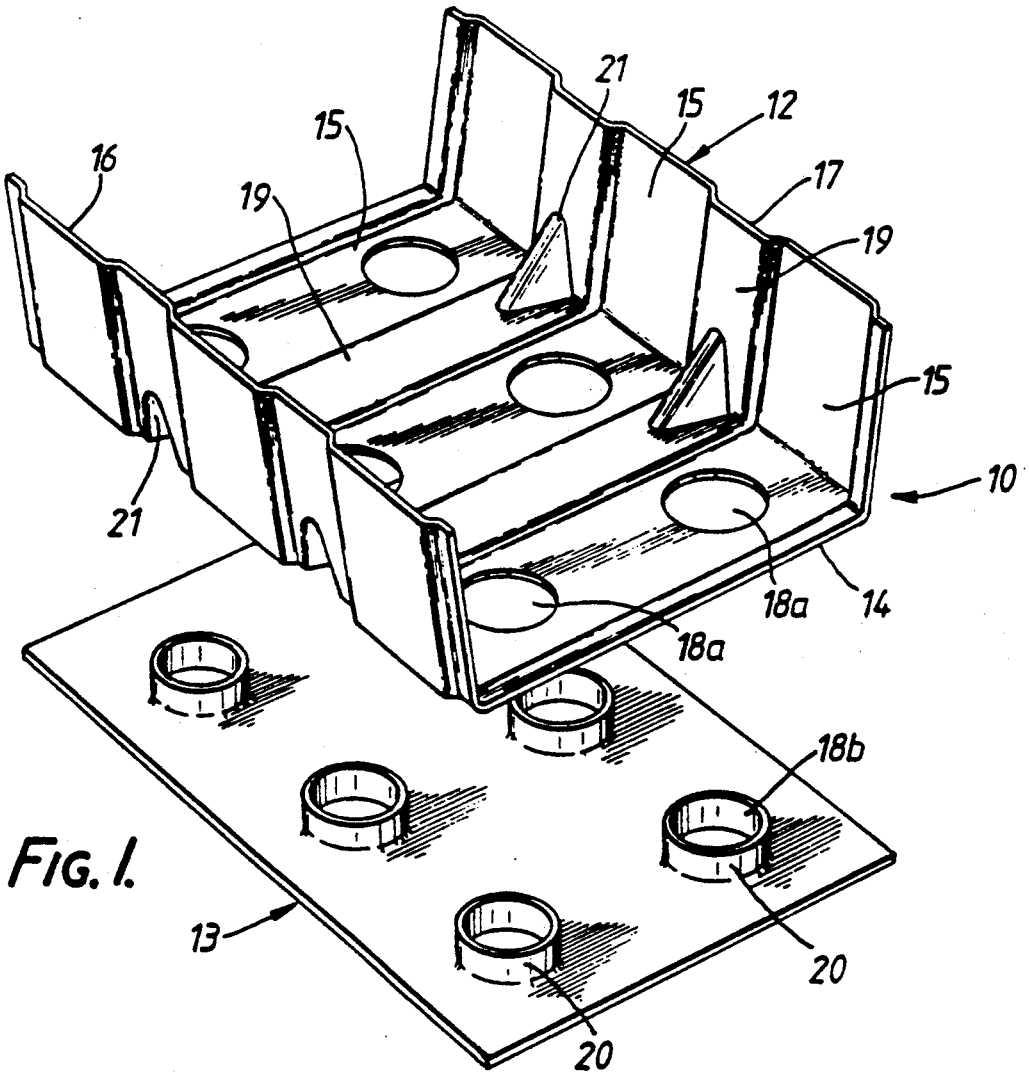
FIG. 1 is a perspective view of an end anchor for a composite steel and concrete structural member, formed in accordance the invention.
Figure 2:
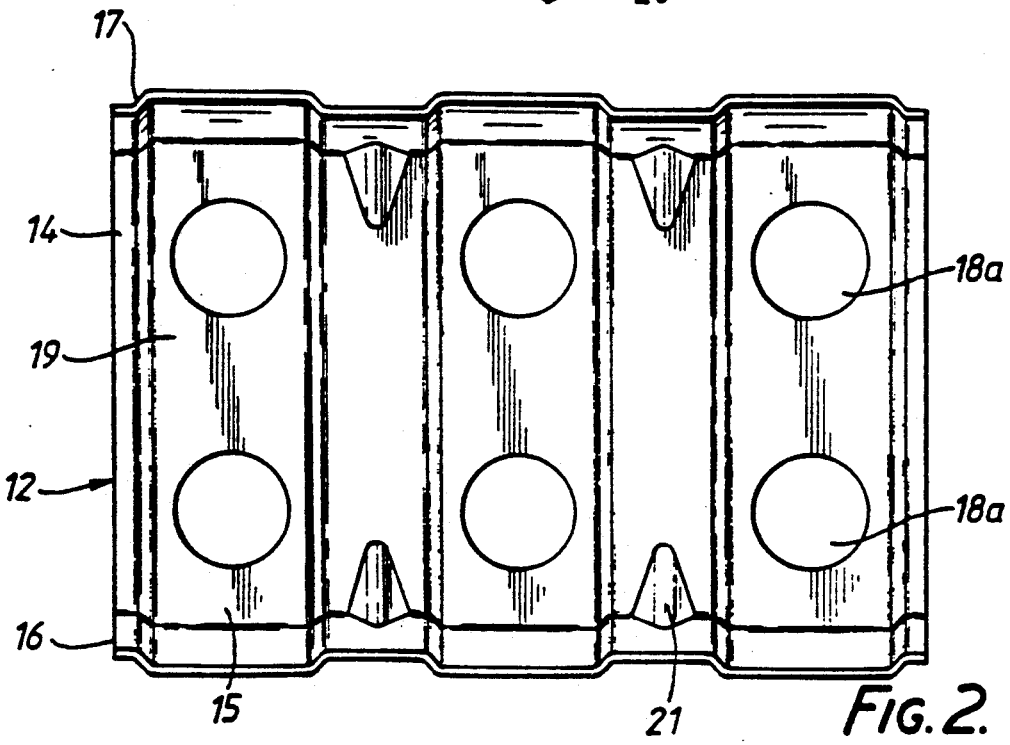
FIG. 2 is a plan view of the end anchor.

The end anchor 10 illustrated in FIGS. 1 to 4 comprises an integral element in the configuration of a broad channel 12, and a backing plate 13. Both are formed in similar substantially rigid sheet material, conveniently structural grade steel plate of gauge between 2.0 and 3.5 mm, most preferably 2.0 mm. Channel 12 has a base 14 and a pair of upstanding flanges 16, 17. The base and flanges are generally flat but do define a pair of spaced transverse shallow ribs 19 separating three pan segments 15. The flanges are each reinforced by a pair of pressed out gussets 21 and are inclined slightly outwardly, e.g. at about 10° to vertical. Six large circular apertures 18*a* are pressed out of the pan segments 15 of base 14 in a uniform 2×3 array. A matching array of six apertures 18*b* are swaged from backing plate 13 so that the displaced plate material forms a set of upstanding annular studs 20 which fit neatly but not necessarily tightly into apertures 18*a*.

Figure 3:
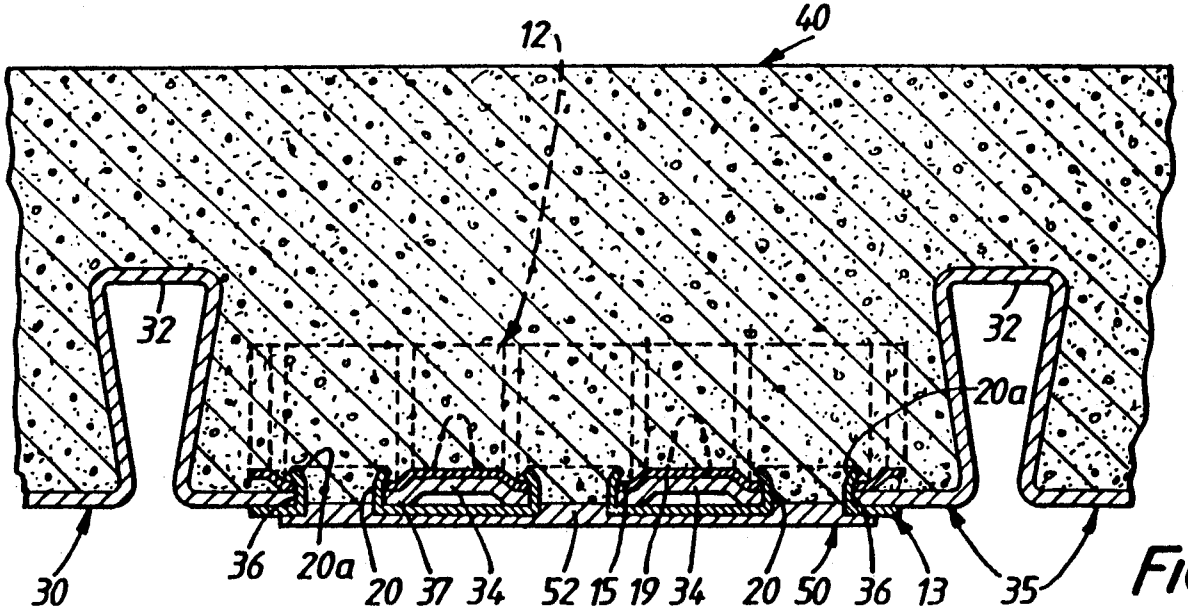
FIG. 3 is a transverse cross-section of a portion of a composite structural member including a decking panel according to the invention with an anchorage comprising the end anchor of FIGS. 1 and 2 in situ.
Figure 4:
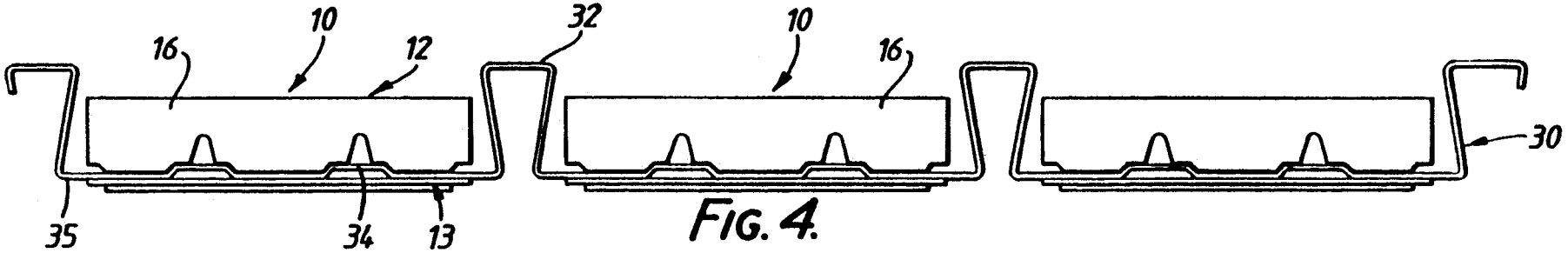
FIG. 4 is an end elevation of the decking panel depicted in FIG. 3 showing additional anchorages.

Channel 12 is dimensioned to neatly fit across a pan of a profiled steel sheet or panel between two successive primary ribs and is shown in situ in FIGS. 3 and 4. The profiled steel sheet 30 there depicted is to serve as a decking panel and has equispaced primary ribs 32 of dovetail section and a pair of intervening shallow stiffening ribs 34 extending along pans 35 to divide the pans into segments 37. Flanges 16, 17 of channel 12 extend across pan 35, at 90° to ribs 32. Dimensions are arranged so that the pan segments 15 and ribs 19 of channel 12 snugly register and nest with panel segments 37 and ribs 34 of panel 30.

As depicted in FIGS. 3 and 4, each anchor 10 is positioned adjacent an end of the panel. Backing plate 13 is in register under the panel and its annular studs 20 project upwardly through complementary prepunched or drilled holes 36 in the pans 35 of panel 30 and through apertures 18*a* in channel 12. To complete the assembly, the outer rims 20*a* of the studs are deformed outwardly by end pressure to lock them into place, clamping the anchor components onto the panel. The panel is thereby sandwiched between the channel and backing plate. The resultant decking panel may be assembled with others to support an overlying cast concrete slab 40.

To form a slab in situ, a lapped array of decking panels 30 are first set out on the provided supports, e.g. structural columns or beams, and fastened temporarily down. An anchor 10 is secured into place at each end of each pan 35, either at this stage or prior to laying the panels, in the manner described above. Reinforcement such as rods or mesh is laid and the concrete is then cast onto the resultant array of panels. When the concrete has cured, a composite deck has been formed.

The openings within studs 20 may be closed by underlying cap 50 with solid studs 52 dimensioned to press fit into studs 20. It is found that the end anchors 10 are very effective in countering longitudinal slippage when the load on a span of the slab causes the adhesion between the metal and cement to breakdown. The two flanges 16, 17 are of substantial thickness and width and provide a large load-bearing surface area in the concrete for each anchor, while the positive discrete engagement of studs 20 in holes 36 ensures a high load bearing capacity at these points before failure of the slab occurs. The slight outward inclination of the flanges enhances coupling to the slab vertically of the metal sheets. It is found that the fatigue life of each stud/hole assembly is highly satisfactory.

Figure 5:
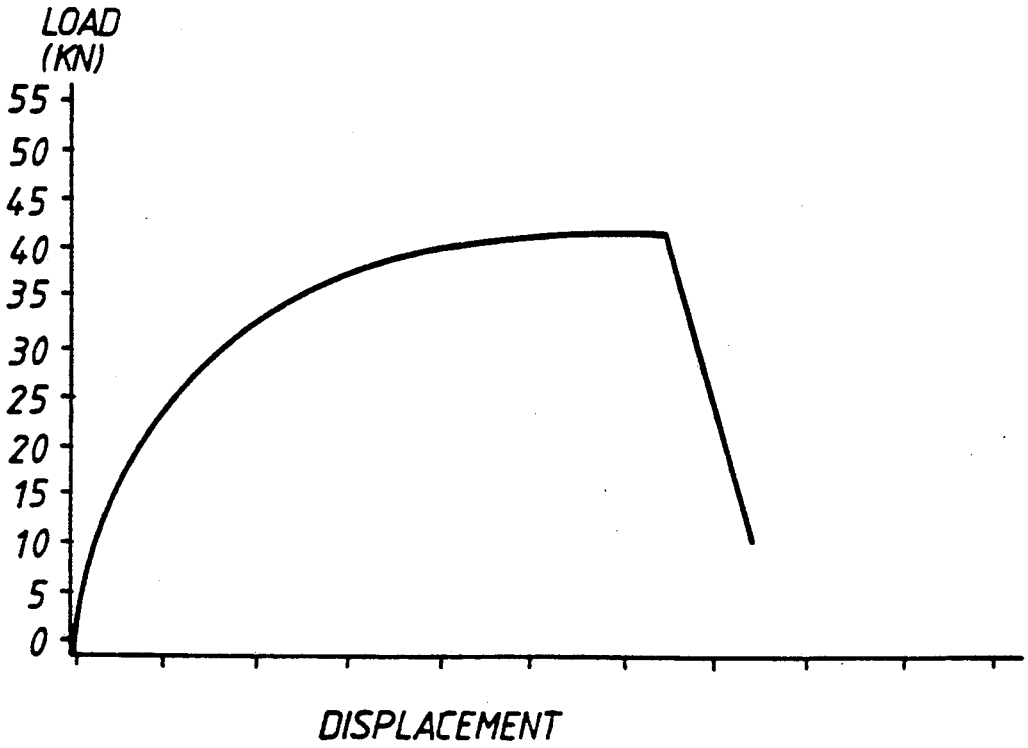
FIG. 5 is a graph showing displacement as a function of load for a simplified form of the anchorage of FIG. 3.

FIG. 5 is a diagram depicting the displacement response to load of a simplified form of the anchorage shown in FIGS. 3 and 4. This simplified form differed only in that there were two instead of six studs: The studs were in nominal 25 mm holes in 0.75 mm metal material. It is believed that the 40 kN load capacity highlighted by the diagram translates to 120 kN for the single six-stud anchorage (i.e. per primary rib end) of FIGS. 3 and 4. This is of the order desired, and contrasts, e.g. with 40 kN for the alternate rib three rod anchorage (i.e. 20 kN per primary rib end) proposed in the aforementioned German patent application 2604399 to Muess.

A significant advantage of the anchor of FIGS. 1 to 4 is that correct positioning of the anchor is not reliant on workers on site but is ensured by providing prepunched holes in the sheet pans. Indeed, in practice, the panel could be delivered from the manufacture with the end anchors secured in place. It will of course be appreciated that studs 20 may depend integrally from channel 12 rather than upstand integrally from plate 13, or may be whole separate inserts, pressed at both rims to secure them in place. The deformation of the rims (best seen in FIG. 3) is preferably such as to contact and slightly deform the underlying hole edge.

Studs 20 are desirably as large as possible (and hence the preferred hollow annular configuration) to maximise the total interface. The practical maximum size of each stud is typically determined by constraints on the size of holes 36, such as the desire for a minimum space between the holes, a requirement that the holes do not excessively reduce the net cross-section, and therefore strength of the sheet and a preference that the holes do not encroach on stiffening ribs 34. A given stud, and the adjacent region about the hole, will then have a maximum shear load capacity and a related fatigue response. The total load capacity and fatigue response of the anchorage as a whole is increased by increasing the number of stud/hole distribution zones, although it is found that six is satisfactory provided there is firm sandwiching of the metal panel between components of the anchors: sandwiching is not critical but its absence results in a need for more studs to achieve a comparable load capacity for the whole anchorage. The size of the anchorage may then become relatively uneconomic. Sandwiching is enhanced by the illustrated close conformity between the rib and pan configurations of the channel 12 and the panel: actual face contact is achieved between the channel, panel and backing plate.

The actual capacity required of each anchorage is of course dependent on the mechanical interaction that is otherwise provided between the panel and the slab. It will also be appreciated that additional anchors may be mounted at intermediate positions along a steel sheet, and that a single sheet may extend across more than one span.

Figure 6:
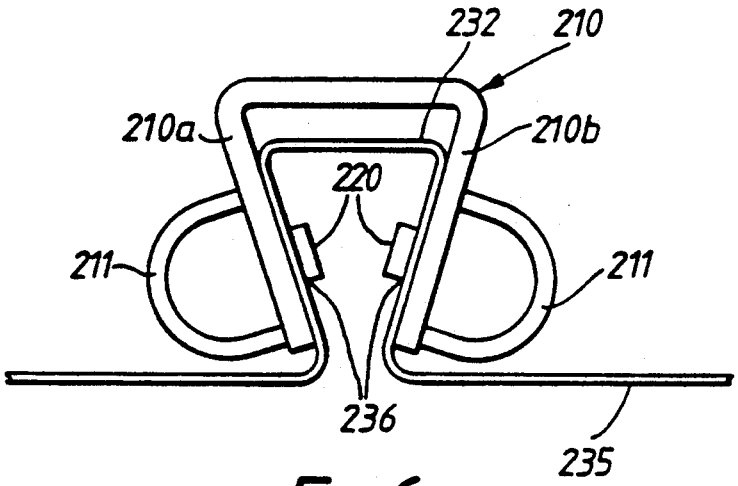
FIG. 6 is a somewhat schematic view of another embodiment of decking panels according to the invention.

FIGS. 6 and 7 depict end anchors which are mounted to the primary ribs rather than the pans of the steel panel. In each case, three discrete anchors are provided to increase the total projected area of engagement.

The anchor 210 shown in FIG. 6 is a generally U-shaped device which embraces the rib and may be formed in spring steel or otherwise adapted to be resiliently expandible for fitting downwardly over the rib. By this is meant that the opposed legs 210*a*, 210*b* of the U, which at equilibrium are inclined towards each other to match the dovetail profile of the rib, may be resiliently moved apart to a parallel relationship so that the anchor 210 can be snapped on over the rib. Each leg may optionally have outstanding rings 211. Again, an anchor may be provided at each end of each rib, and each anchor leg has an inside stud 220 which locates snugly in a preformed hole 236 in the respective side of the rib.

There may be three separate anchors 210 at each end of a rib or, alternatively, the anchor 210 may be an elongate inverted channel with e.g. three studs in engagement with holes in each side of the rib.

Figure 7A:
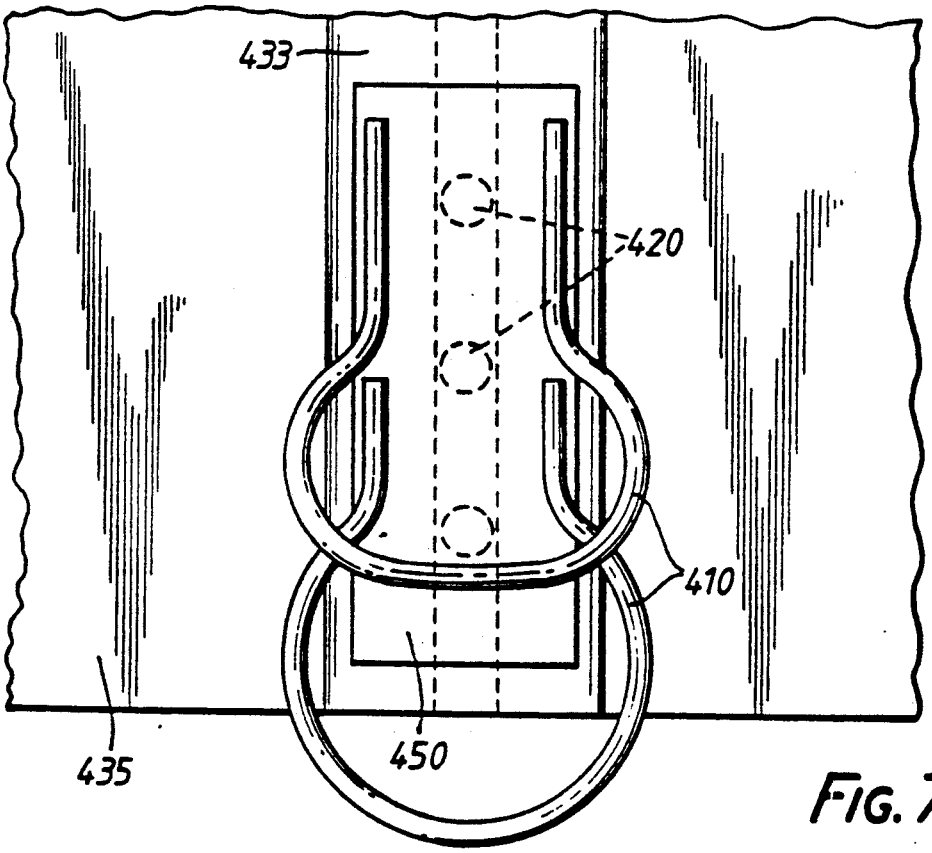
FIGS. 7A and 7B are plan and end elevational views of a further embodiment of the invention.
Figure 7B:
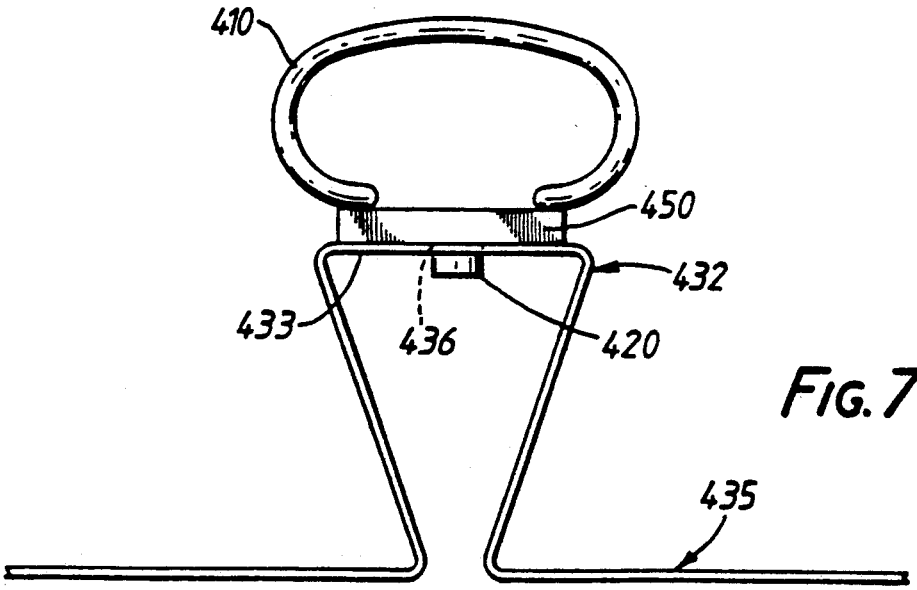

In FIGS. 7A and 7B are depicted an alternative to the embodiments of FIG. 6. The rings 410 (two as illustrated) are welded to a plate 450 which rests on the top web 433 of the rib 432 and has a plurality of depending studs 420 in engagement with holes in web 433.

I claim:

1. A decking panel for a composite metal and concrete structural member and onto which in use a slab of concrete is cut to form said composite member, said decking panel comprising:

a metal sheet formed to define a plurality of longitudinally extending ribs, and at least one intervening pan;

a plurality of end anchors secured to said metal sheet to anchor said metal sheet with an overlying concrete slab against relative mechanical slippage in a direction parallel to the ribs, said plurality of end anchors being disposed adjacent ends of said metal sheet relative to the direction parallel to the ribs; and sets of holes in said metal sheet associated with each of said end anchors, each of said sets being in at least one of an individual rib and pan of said metal sheet, wherein each of said end anchors includes a portion projecting from said metal sheet, means for holding a respective end anchor in said metal sheet and an element of substantially rigid sheet material defining a base portion and at least one flange portion upstanding from the base portion, wherein the element lies across the pan of said metal sheet with the flange portion extending across the pan, and further the means for holding said respective end anchor includes a plurality of stud elements engageable with a respective set of holes in said metal sheet and formed such that each of the plurality of stud elements extends through a corresponding hole within the respective set of holes.

2. A decking panel according to claim 1 wherein the means for holding said respective end anchor includes a plurality of stud elements of annular cross-section.

3. A decking panel according to claim 1 wherein the rigid sheet element includes an integral channel which defines the base portion and a pair of the at least one upstanding flange portions disposed at opposite edges of the base portion.

4. A decking panel according to claim 3 wherein the flange portions are inclined outwardly with respect to the base portion.

5. A decking panel according to claim 1 wherein the plurality of stud elements are formed to project integrally from a common backing plate through corresponding holes within the respective set of holes in said metal sheet and registering apertures in the base portion.

6. A decking panel according to claim 5 wherein outer rims of each of the plurality of stud elements are deformed outwardly to lock into place, thereby clamping the base portion and the backing plate onto said metal sheet so as to sandwich said metal sheet between the base portion and the backing late.

7. A decking panel according to claim 5 wherein there are six of the plurality of stud elements arranged in a $3\times2$ array.

8. A decking panel according to claim 1 wherein there are at least two of the upstanding flange portions.

9. A decking panel according to claim 8 wherein said plurality of end anchors are secured to the ribs of said metal sheet and each of said plurality of end anchors includes a generally U-shaped or ring device constructed from a plain reinforcing bar, which embraces a respective rib.

10. A decking panel according to claim 9 wherein the U-shaped or ring device is resiliently expandable for fitting over the respective rib.

11. A composite metal and concrete structural member comprising a slab of concrete cast on a decking panel according to claim 1.

12. A decking panel for a composite metal and concrete structural member and onto which in use a slab of concrete is cut to form said onto which in use a slab of concrete is cut to form said composite member, said decking panel comprising:

a metal sheet formed to define a plurality of longitudinally extending ribs, and at least one intervening pan;

a plurality of end anchors secured to said metal sheet to anchor said metal sheet with an overlying concrete slab against relative mechanical slippage in a direction parallel to the ribs, said plurality of end anchors being disposed adjacent ends of said metal sheet relative to the direction parallel to the ribs; and sets of holes in said metal sheet associated with each of said end anchors, each of said sets being in at least one of an individual rib and pan of said metal sheet, wherein each of said end anchors includes a portion projecting from said metal sheet and means for holding a respective end anchor in said metal sheet, and further the means for holding said respective end anchor includes a plurality of stud elements engageable with a respective set of holes in said metal sheet and formed such that each of the plurality of stud elements extends through a corresponding hole within the respective set of holes, and further the decking panel including complementary inter-engaged shallow ribs in said metal sheet and in each of said plurality of end anchors.

13. An anchor for composite metal and concrete structural members which comprises:

an element of substantially rigid sheet material defining a base portion and at least two flange portions upstanding from the base portion and extending longitudinally along said element; and means co-operable with the base portion for holding said element, wherein said holding means includes a plurality of stud elements engageable with respective complementary holes in a ribbed metal sheet for a composite metal and concrete structural member, the plurality of stud elements being formed to project integrally from a common backing plate through the holes in the metal sheet and registering apertures in the base portion.

14. An anchor according to claim 13 wherein said element includes an integral channel which defines the base portion and a pair of the upstanding flange portions disposed at opposite edges of the base portion.

15. An anchor according to claim 14 wherein the flange portions are inclined outwardly with respect to the base portion.

16. An anchor according to claim 13 further comprising gusset means between the base portion and the flange portion portions.

17. An anchor according to claim 13 wherein the plurality of stud elements are of annular cross-section.

18. A decking panel according to claim 13 wherein there are six of the plurality of stud elements arranged in a 3×2 array.

19. An anchor according to claim 13 further including shallow ribs in the base portion extending transversely to the flange portions.

20. An anchor according to claim 13 wherein there are six of the plurality of stud elements arranged in a 3×2 array.

21. A decking panel for a composite metal and concrete structural member and onto which in use a slab of concrete is cut to form said composite member, said decking panel comprising:

a metal sheet formed to define a plurality of longitudinally extending ribs, and at least one intervening pan;

a plurality of end anchors secured to said metal sheet to anchor said metal sheet with an overlying concrete slab against relative mechanical slippage in a direction parallel to the ribs, said plurality of end anchors being disposed adjacent ends of said metal sheet relative to the direction parallel to the ribs; and sets of holes in said metal sheet associated with each of said end anchors, each of said sets being in at least one of an individual rib and pan of said metal sheet, wherein each of said end anchors includes a portion projecting from said metal sheet and means for holding a respective end anchor in said metal sheet, and further the means for holding said respective end anchor includes six stud elements engageable with a respective set of holes in said metal sheet and formed such that each of the plurality of stud elements extends through a corresponding hole within the respective set of holes, the six stud elements being arranged in a 3×2 array.

22. A decking panel for a composite metal and concrete structural member and onto which in use a slab of concrete is cast to form said composite member, said decking panel comprising:

a metal sheet formed to define a plurality of longitudinally extending ribs, and at least one intervening pan;

a plurality of end anchors secured to said metal sheet to anchor said metal sheet and an overlying concrete slab against relative mechanical slippage in a direction parallel to the ribs, said plurality of end anchors being disposed adjacent ends of said metal sheet relative to the direction parallel to the ribs; and sets of holes in said metal sheet associated with each of said plurality of end anchors, each of said sets of holes being in at least one of an individual rib and pan of said metal sheet, wherein each of said plurality of end anchors includes a portion projecting from said metal sheet, and means engageable with a respective set of holes in said metal sheet for holding a respective end anchor in said metal sheet, and further each of said plurality of end anchors includes an element of substantially rigid sheet material defining a base portion and at least one flange portion upstanding from the base portion and extending longitudinally along the rigid sheet element.

23. A decking panel according to claim 22, wherein the means engageable with the respective set of holes includes a plurality of stud elements disposed for extending through holes of the respective set of holes.

24. A decking panel according to claim 23 wherein each of the plurality of stud elements are of annular cross-section.

25. A decking panel according to claim 22 wherein each of the rigid sheet elements lies across a pan of said metal sheet with the upstanding flange portion of the rigid sheet element extending across the pan.

26. A decking panel according to claim 25 wherein there are two of the upstanding flange portions.

27. A decking panel according to claim 22 wherein said rigid sheet element includes an integral channel which defines the base portion and a pair of the upstanding flange portions disposed at opposite edges of the base portion.

28. A decking panel according to claim 27, wherein the flange portions are inclined outwardly with respect to the base portion.

29. A decking panel according to claim 23 wherein the plurality of stud elements are formed to project integrally from a common backing plate through the holes in said metal sheet and registering apertures in the base portion.

30. A decking panel according to claim 29 wherein outer rims of each of the plurality of stud elements are deformed outwardly for locking into place, thereby clamping the base portion and the backing plate onto said metal sheet so as to sandwich said metal sheet between the base portion and the backing plate.

31. A decking panel according to claim 29 wherein there are six of the plurality of stud elements arranged in a 3×2 array.

32. A decking panel according to claim 22 wherein there are six of the plurality of stud elements arranged in a 3×2 array.

33. A decking panel according to claim 22 further including complementary inter-engaged shallow ribs in said metal sheet and in each of said plurality of end anchors.

34. A decking panel according to claim 22 wherein the end anchors are secured to the ribs of the metal sheet and each comprise a generally U-shaped or ring device constructed from plain reinforcing bar, which embraces the respective rib.

35. A decking panel according to claim 34 wherein said device is resiliently expandable for fitting over the rib.

36. A composite metal and concrete structural member comprising a slab of concrete cast on a decking panel according to claim 22.

* * * * *

UNITED STATES PATENT AND TRADEMARK OFFICE

CERTIFICATE OF CORRECTION

PATENT NO. : 5,107,650

DATED : April 28, 1992

INVENTOR(S) : Mark PATRICK

It is certified that error appears in the above-identified patent and that said Letters Patent is hereby corrected as shown below:

On the cover page, after Item [87], the following should appear:

-- [30] Foreign Application Priority Data

Jun. 5, 1987 [AU] Australia ..... PI 2335/87
Nov. 9, 1987 [AU] Australia ..... PI 5306/87 --.

Signed and Sealed this

Twentieth Day of July, 1993

Attest:

Michael K. Kirk

MICHAEL K. KIRK

Attesting Officer

Acting Commissioner of Patents and Trademarks